US006271627B1

(12) United States Patent
Morimoto et al.

(10) Patent No.: US 6,271,627 B1
(45) Date of Patent: Aug. 7, 2001

(54) SEALING BODY HAVING A SHIELDING LAYER FOR HERMETICALLY SEALING A TUBE LAMP

(75) Inventors: Yukihiro Morimoto; Kazuyuki Mori, both of Himeji; Kenichi Mituhashi, Tukuba; Shoji Miyanaga, Takasago, all of (JP)

(73) Assignees: Ushiodenki Kabushiki Kaisha, Tokyo; Toto Ltd., Kita-Kyushu, both of (JP)

( * ) Notice: Subject to any disclaimer, the term of this patent is extended or adjusted under 35 U.S.C. 154(b) by 0 days.

(21) Appl. No.: 09/147,115

(22) PCT Filed: Apr. 8, 1998

(86) PCT No.: PCT/JP98/01625

§ 371 Date: Oct. 6, 1998

§ 102(e) Date: Oct. 6, 1998

(87) PCT Pub. No.: WO98/47169

PCT Pub. Date: Oct. 22, 1998

(30) Foreign Application Priority Data

Apr. 11, 1997 (JP) ..... 9-108345

(51) Int. Cl.[7] ..... H01J 17/18; H01J 61/36

(52) U.S. Cl. ..... 313/623; 313/624; 313/625; 313/626

(58) Field of Search ..... 313/623, 625, 313/324, 626, 634

(56) References Cited

U.S. PATENT DOCUMENTS

| | | | | |
|---|---|---|---|---|
| 455,069 | * | 6/1891 | Tesla | 313/305 |
| 3,675,068 | * | 7/1972 | Strauss | 313/623 |
| 3,676,730 | * | 7/1972 | Loughridge et al. | 313/623 |
| 3,753,026 | | 8/1973 | Goorissen . | |
| 4,074,167 | | 2/1978 | Van Den Broek et al. . | |
| 4,673,843 | * | 6/1987 | Okanuma | 313/623 |

(List continued on next page.)

FOREIGN PATENT DOCUMENTS

| | | |
|---|---|---|
| 2 700 061 | 7/1994 | (FR) . |
| 1 442 497 | 7/1976 | (GB) . |
| 8-77976 | 3/1996 | (JP) . |
| 8-138555 | 5/1996 | (JP) . |
| 9-115484 | 5/1997 | (JP) . |
| 9-123186 | 5/1997 | (JP) . |
| 10-40867 | 2/1998 | (JP) . |
| 10-40868 | 2/1998 | (JP) . |
| 10-40869 | 2/1998 | (JP) . |
| 10-125284 | 5/1998 | (JP) . |
| 10-172514 | 6/1998 | (JP) . |
| WO 94/06947 | 3/1994 | (WO) . |

OTHER PUBLICATIONS

Microfilm of the Specification and Drawing Sannexed to the Request of Japanese Utilitymodel Application No. 163134/1982, (Laid–Open No. 67855/1984) (Iwasaki Electric Co., LTD.), May 8, 1984, Claim 1, p. 5, Lines 10 to 16; Fig. 2, (Family: None).

*Primary Examiner*—Nimeshkumar D. Patel
*Assistant Examiner*—Mariceli Santiago
(74) *Attorney, Agent, or Firm*—Nixon Peabody LLP; David S. Safran

(57) ABSTRACT

A sealing body (5) of a tube lamp using a functional gradient material in which proceeding from electrically conductive areas into the vicinity of welds on one side tube (2) and in outer leads (6) oxidation is suppressed, and in which the service life of the tube lamp is prolonged. The sealing body (5) of a tube lamp consist of a functional gradient material which is formed by mixing of a dielectric material and an electrically conductive material, the mixing ratios in the longitudinal direction being different continuously or incrementally, and in which one end forms a dielectric area and the other end forms an electrically conductive area, and by at least one part of the external surface of this electrically conductive area and/or at least one part of outer lead (6) projecting from sealing body (5) being jacketed with an atmosphere shielding layer (7).

3 Claims, 1 Drawing Sheet

U.S. PATENT DOCUMENTS 4,795,943 * 1/1989 Antonis et al. ..... 313/623
5,424,609 * 6/1995 Geven et al. ..... 313/623
5,557,169 * 9/1996 Van Lierop et al. ..... 313/623
5,932,969 * 8/1999 Ikeuchi et al. ..... 313/623
6,084,352 * 7/2000 Seki et al. ..... 313/626

* cited by examiner

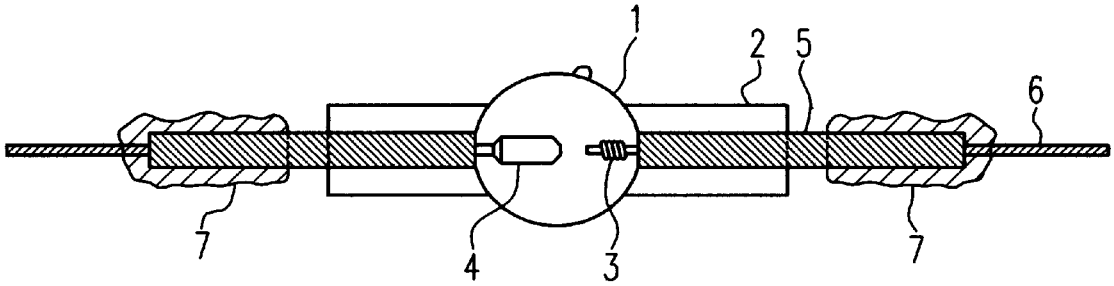
FIG. 1
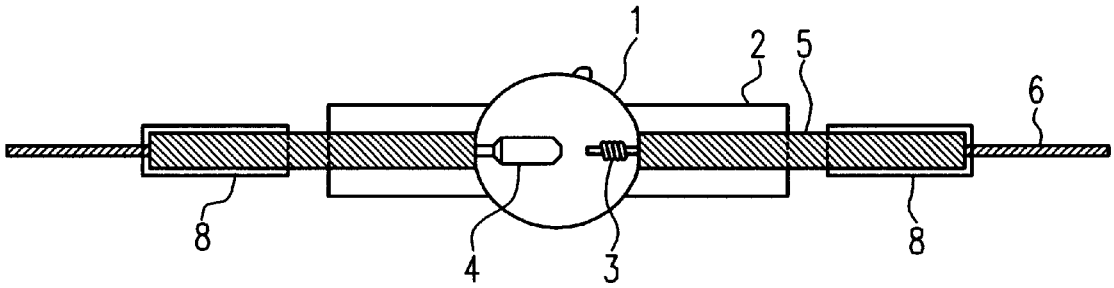
FIG. 2
Remaining number in operation after 0 to 2000 hours
| | | Integral test time (hours) | | | | |
|---|---|---|---|---|---|---|
| | | 0 | 100 | 300 | 1000 | 2000 |
| Remaining number in operation | Conventional example | 5 | 3 | 0 | 0 | 0 |
| | Embodiment 1 | 5 | 5 | 5 | 5 | 5 |
| | Embodiment 2 | 5 | 5 | 5 | 5 | 5 |
| | Embodiment 3 | 5 | 5 | 5 | 5 | 5 |
FIG. 3

SEALING BODY HAVING A SHIELDING LAYER FOR HERMETICALLY SEALING A TUBE LAMP

TECHNICAL FIELD

The invention relates to a sealing body for hermetic sealing of a tube lamp.

DESCRIPTION OF RELATED ART

A functional gradient material was formerly used as a sealing body in the sealed portions of a tube lamp such as a discharge lamp, an electric light bulb or the like. In a sealing body of this type an electrically conductive component and a dielectric component change continuous or incrementally. This property is suitable for a sealed arrangement of a discharge lamp or a filament lamp, i.e., for a feed arrangement as well as a hermetically sealed arrangement thereof.

Use of this functional gradient material as a sealing body for a tube lamp, such as a discharge lamp, a filament lamp or the like, yields the advantage that the length of the sealed portions (the feed sites as well as the hermetically sealed portions) can be shortened considerably more than in a conventional tube lamp. This prior art is for example known from documents WO 94/06947, WO 94/01884 and related others.

In a tube lamp of this type, in which a functional gradient material is used as a sealing body, the length of the sealed portions can be shortened. The result is the major advantage that the length of the entire tube lamp can be shortened. During operation of the lamp, the sealing body however reaches extremely high temperature and in this area oxidation occurs. In the sealing bodies outer leads are attached for purposes of supply such that they project outward. When an oxide is produced in the areas in which these outer leads are attached to the sealing bodies, the electrical contact resistance increases in these areas; this causes the disadvantage of shortened lamp service life. This disadvantage arises not just for a discharge lamp, but also for a filament lamp, such as a halogen lamp or the like.

DISCLOSURE OF THE INVENTION

In view of the body of prior art described above, as claimed in the invention a sealing body for a tube lamp which is described below is given.

(1) In a sealing body for a tube lamp, such as a discharge lamp, a filament lamp or the like, the invention is characterized in that it consists of a functional gradient material which is formed by mixing of a dielectric material and an electrically conductive material, the mixing ratios being different in the longitudinal direction continuously or incrementally, and in which one end forms a dielectric area and the other end forms an electrically conductive area and that at least one part of the external surface of this electrically conductive area and/or at least one part of the outer lead projecting out of this sealing body is jacketed with an atmosphere shielding layer.

(2) The invention is furthermore characterized in that in the design described above (1) the atmosphere shielding layer is made of glass, a thin layer of a metal such as platinum, gold, rhodium, iridium, rhenium or chromium or a metal compound such metal oxide.

BRIEF DESCRIPTION OF THE DRAWING

FIG. 1 shows a schematic of one embodiment of a tube lamp using the sealing body as claimed in the invention;

FIG. 2 shows a schematic of another embodiment of a tube lamp using the sealing body as claimed in the invention;

FIG. 3 shows a schematic of the result of an experiment with the sealing body as claimed in the invention.

BEST MODE FOR CARRYING OUT THE INVENTION

FIG. 1 shows schematically one embodiment of a tube lamp using the sealing body as claimed in the invention. As the tube lamp a discharge lamp is used which consists of arc tube 1, inside of which there is an emission space, and of side tube 2 which projects from both ends of this arc tube 1. In this emission space there are cathode 3 and anode 4 opposite one another. Arc tube 1 and side tube 2 are made of silica glass (fused quartz).

Reference number 5 labels a sealing body which has an essentially cylindrical overall shape and consists of a functional gradient material which is comprised of silicon dioxide as a dielectric component and molybdenum as an electrically conductive component. That is, one end of sealing body 5 is rich in the molybdenum component and is electrically conductive, and the silicon dioxide component increases towards the other end continuously or incrementally, so that the other end is rich in the silicon dioxide component and is dielectric.

This sealing body 5 with approximately cylindrical shape is arranged such that the dielectric end walls which are rich in silicon dioxide are adjacent to the emission space and their external surfaces are welded to the inside of side tube 2, thereby attaining essentially hermetic sealing. This connection, that is, the connection of side tube 2 to sealing bodies 5, is effected in an area in which the content of electrically conductive component of sealing body 5 is less than 2% by volume.

On the other hand, cathode 3 and anode 4 are each essentially centered in sealing body 5, are inserted into an opening of sealing body 5 which extends lengthwise, and project above it. Furthermore, cathode 3 and anode 4 are in the electrically conductive areas of sealing body 5, that is, in the areas rich in the electrically conductive component, and are hardened into sealing body 5 and electrically connected. Outer leads 6 project to the outside from sealing bodies 5. Like electrodes 3, 4, they are essentially centered on the end walls of sealing body 5, are inserted into an opening of sealing body 5 which extends lengthwise, and likewise are connected to sealing bodies 5 in the electrically conductive areas, thereby creating an electrical connection of the electrodes to the outer leads.

According to one embodiment of the invention, at least one part of outer leads 6 and at least one part of the exterior surfaces of the electrically conductive areas of the sealing body are jacketed with an atmosphere shielding layer. Atmosphere shielding layer 7 jackets areas of the sealing body with a content of electrically conductive component greater than or equal to 2% by volume and areas of outer leads 6 which are located in the vicinity of sealing body 5. The reason why the areas with a content of electrically conductive component of greater or equal than 2% are jacketed is that the areas with a content of electrically conductive component of less than 2% by volume are welded to side tube 2, as described above, and that therefore the sealing bodies are thus shielded from the atmosphere.

Atmosphere shielding layer 7 can be made from glass material such as borosilicate glass or the like. It is not, however, limited to glass and can also be made of a thin layer of a metal or metal compound, such as a metal oxide, like silicon dioxide ($SiO_2$), lead dioxide ($PbO_2$), titanium dioxide ($TiO_2$), aluminum oxide ($Al_2O_3$), cerium dioxide ($CeO_2$), or the like. Platinum (Pt), gold (Au), rhodium (Rh), iridium (Ir), rhenium (Re), chromium (Cr), or the like can be used as a metal.

Furthermore, the sealing bodies are not limited to a combination of molybdenum with silicon dioxide. The electrically conductive material can be molybdenum (Mo), tungsten (W), platinum (Pt), nickel (Ni), tantalum (Ta), zirconium (Zr) or the like, while the dielectric material can be aluminum oxide ($Al_2O_3$), yttrium oxide ($Y_2O_3$), magnesium oxide (MgO), calcium oxide (CaO), zirconium dioxide ($ZrO_2$) or the like.

As shown in FIG. 1, atmosphere shielding layer 7 can actually be located both at least in one part of the external surfaces of the electrically conductive areas and also at least in one part of the outer leads. However, the layer can also be located only in one of the two cases.

Furthermore, the tube lamp is not limited to a discharge lamp, but can also be used for an infrared heating apparatus or the like, in which a halogen lamp or a tube made of fused silica glass is filled with heat-generating filler. Furthermore, the tube lamp is not limited to an AC or DC type. In addition, in the case of a discharge lamp, an application can be found for a mercury lamp, xenon lamp, metal halide lamp, or the like, that is, without limitation of the type.

Specific numerical figures are given below in one example:

The tube lamp is a metal halide lamp with a lamp input power of 150 W. The arc tube is made of silica glass. The arc tube, that is, the emission space, is approximately spherical and has an external diameter of 11 mm. Anode 4 is made of tungsten, and cathode 3 is made of thoriated tungsten. Sealing bodies 5 made of a functional gradient material are cylindrical in shape overall. Their external diameter is 2.8 mm and length is 20 mm. There is a 2 mm distance between the lamp electrodes. The filling material is 20 mg of mercury, dysprosium iodide, neodymium iodide and cesium iodide together in an amount of 0.4 mg, 0.25 mg indium bromide, and 500 Torr argon.

The borosilicate glass used for the atmosphere shielding layer has a coefficient of linear expansion of $25\times10^{-7}$/K. As the coating process a glass tube with a thickness of 0.5 mm was seated on the sealing bodies, and the sealing bodies were annealed in a flame to a temperature of 1500° C., thereby obtaining a weld. Coating is however not limited to this process, but can also be accomplished by a method in which a pulverized glass material in an organic binder is dissolved and applied, and in which furthermore after drying an annealing process is carried out with a flame in such a way that a temperature of roughly 1500° C. is reached, thereby obtaining a weld.

Another embodiment is described below.

In this embodiment which is shown in FIG. 2, the atmosphere shielding layer is a silicon dioxide ($SiO_2$) film. $SiO_2$ film 8 was created by reactive sputtering in an argon and oxygen atmosphere using a silicon target with a layer thickness of 100 microns. Sputtering was carried out under conditions of a gas pressure of 0.01 Torr, an ion current of 3 mA/cm$^2$ and an acceleration voltage of 2 kV.

Instead of $SiO_2$ film 8, a lead dioxide ($PbO_2$) film can be used. In this case, after welding and sealing of sealing body 5 to side tube 2, at room temperature a solution of lead nitrate is applied, dried at room temperature, and sintered at 550° C. In this way, a $PbO_2$ film 10 to 100 microns thick is formed.

The atmosphere shielding layer is not limited to $SiO_2$ or $PbO_2$, but can also be formed from a thin layer of another metal oxide such as titanium dioxide ($TiO_2$), aluminum oxide ($Al_2O_3$), cerium dioxide ($CeO_2$) or the like.

One example is described below, in which the atmosphere shielding layer is made of a platinum (Pt) film. The platinum film was formed by sputtering in an argon atmosphere using a Pt target with a layer thickness of 100 microns. The sputtering was carried out under conditions of a gas pressure of 0.01 Torr, an ion current of 1 mA/cm$^2$ and an acceleration voltage of 15 kV.

In this case, the atmosphere shielding layer is not limited to a platinum film, but can also be made of a thin layer of any one of these metals: gold, rhodium, iridium, rhenium or chromium. Coating with the previously described $SiO_2$ film or the platinum film is done here in the sealing bodies after completion of the lamp. During sputtering, the arc tube of the lamp is therefore covered with a strip of aluminum or the like to prevent formation of a sputtering film in this area.

Next, a burning life test was carried out using a conventional metal halide lamp without an atmosphere shielding layer and the previously described three metal halide lamps. The "previously described three metal halide lamps" are defined as the lamp using borosilicate glass as the atmosphere shielding layer (embodiment 1), the lamp using $SiO_2$ film as the atmosphere shielding layer (embodiment 2), and the lamp using a platinum film as the atmosphere shielding layer (embodiment 3).

The durability test was carried out under conditions of a number of samples equal to five lamps at a time and a blinking mode of 2 hours and 45 minutes on and 15 minutes off. The conventional metal halide lamp has the same specifications as the previously described metal halide lamps for embodiments 1, 2 and 3. FIG. 3 shows how much the remaining number in operation from 0 to 2000 hours after starting the burning life test. "Remaining number in operation" is defined as the number of lamps, for which those particular lamps are excepted in which by the occurrence of oxidation an anomalous discharge has occurred and in which operation has ceased.

It is clear from this result that in conventional tube lamps without an atmosphere shielding layer, oxidation has taken place up to 300 hours after the start of operation, proceeding from the molybdenum end walls of the sealing bodies into the vicinity of the sealed portions, causing the voltaic electricity resistance to increase. In these areas an anomalous charge was generated, causing operation to cease. In the case of a conventional tube lamp the average burning life of the five test lamps was 189 hours. In tube lamps using the sealing bodies as claimed in the invention, in embodiments 1 to 3 which are provided with the atmosphere shielding layer, normal operation continued even after 2000 hours of operation. It was therefore confirmed that the service life of tube lamps as claimed in the invention is at least ten times longer than in tube lamps without a coating.

In these sealing bodies for tube lamps as claimed in the invention, at least one part of the external surfaces of the electrically conductive areas and/or at least one part of the outer leads projecting from these sealing bodies are jacketed with an atmosphere shielding layer. In this way, oxidation is minimized or prevented in the vicinity of the welds of the sealing bodies to the side tubes as well as in areas in which the outer lead wires are shrunk on. Thus the service life of the tube lamp is considerably lengthened.

Commercial Application

As described above, sealing bodies for a tube lamp as claimed in the invention can be used in a hermetically sealed arrangement of a discharge lamp, such as a metal halide lamp or the like, or a filament lamp such as a halogen lamp or the like.

What is claimed is:

1. Sealing body for a tube lamp, said sealing body comprising: a material with a gradient function which is formed by mixing of a dielectric material and an electrically conductive material, the mixing ratios being different in the longitudinal direction, continuously or incrementally, and wherein an outer lead projects from a first end of the material with a gradient function; wherein a second end of the material with a gradient function forms a dielectric area and the first end forms an electrically conductive area, wherein at least a part of the external surface of the electrically conductive area near the outer lead and at least a part of the outer lead projecting from the first end of the sealing body are jacketed with an atmosphere shielding layer.

2. Sealing body for a tube lamp as claimed in claim 1, wherein the atmosphere shielding layer is made of glass, a thin layer of one of the metals platinum, gold, rhodium, iridium, rhenium, chromium, or a metal compound thereof.

3. Sealing body for a tube lamp as claimed in claim 1, wherein the part of the conductive area which is jacketed with an atmosphere shielding layer is a portion of the sealing body in which the conductive material content of the sealing body is at least 2% by volume.

* * * * *